US006935801B1

(12) United States Patent
Kuo

(10) Patent No.: US 6,935,801 B1
(45) Date of Patent: Aug. 30, 2005

(54) PEN HAVING UNWINDABLE NOTE PAPER SHEET

(76) Inventor: Ming Mei Kuo, P.O.Box 10-69, Chong Ho, Taipei (TW) 235

( * ) Notice: Subject to any disclaimer, the term of this patent is extended or adjusted under 35 U.S.C. 154(b) by 0 days.

(21) Appl. No.: 10/801,869

(22) Filed: Mar. 12, 2004

(51) Int. Cl.[7] ..... B43K 29/00
(52) U.S. Cl. ..... 401/195
(58) Field of Search ..... 401/52, 195

(56) References Cited

U.S. PATENT DOCUMENTS 2,005,110 A * 6/1935 Ritzert ..... 281/5
2,099,268 A * 11/1937 Henson et al. ..... 242/379
2,301,364 A * 11/1942 Bruck et al. ..... 401/52
2,512,168 A * 8/1950 Moore ..... 206/389
3,963,358 A * 6/1976 Houser ..... 401/195
4,812,069 A * 3/1989 White et al. ..... 401/195
4,872,775 A * 10/1989 Chang ..... 401/52
5,570,967 A 11/1996 Chen ..... 401/195
6,283,661 B1 * 9/2001 Connors ..... 401/195

* cited by examiner

*Primary Examiner*—David J. Walczak

(57) ABSTRACT

A pen includes a housing having a slot, an ink reservoir received in the housing, and a sheet material received in the housing and movable out of the housing via the slot of the housing for noting purposes. The housing includes a rotatable tube, and the sheet material may be wound around the tube, and a casing may be rotatably attached to the housing and coupled to the tube, to rotate the tube relative to the housing and thus to move the sheet material relative to the housing. The housing includes an anchor device engaged with the tube with such as teeth engagements to guide the tube to rotate relative to the housing.

1 Claim, 7 Drawing Sheets

PEN HAVING UNWINDABLE NOTE PAPER SHEET

BACKGROUND OF THE INVENTION

1. Field of the Invention

The present invention relates to a pen, and more particularly to a pen having a note paper sheet engaged therein and unwindable by users for easily note taking purposes.

2. Description of the Prior Art

Typical pens comprise an ink reservoir received and engaged in a housing for writing purposes.

The other typical pens may comprise an ink reservoir that may be retractably received and engaged in the housing, and selectively actuateable or movable out of the housing for writing purposes. The ink reservoir may also be retracted and received in the housing after use.

For example, U.S. Pat. No. 5,570,967 to Chen discloses one of the typical pens including an actuating device to selectively actuate the ink reservoir into and out of the housing.

However, the typical pens provide the ink reservoir for writing purposes only, but fail to provide any note paper sheet, such that the pen users may not easily take notes.

The present invention has arisen to mitigate and/or obviate the afore-described disadvantages of the conventional pens.

SUMMARY OF THE INVENTION

The primary objective of the present invention is to provide a pen including a note paper sheet engaged therein and unwindable by users for easily note taking purposes.

In accordance with one aspect of the invention, there is provided a pen comprising a housing including a slot formed therein, an ink reservoir received in the housing, and a sheet material received in the housing and movable out of the housing via the slot of the housing for noting purposes.

The housing includes a tube rotatably received therein, the sheet material is wound around the tube. A rotating device may further be provided to rotate the tube relative to the housing, and includes a casing rotatably attached to the housing, and coupled to the tube, to rotate the tube relative to the housing.

The casing includes at least one notch formed therein, the tube includes at least one jut extended therefrom to engage into the notch of the casing, and to anchor the tube to the casing. The tube includes a peripheral rib extended therefrom to engage with the casing.

The housing includes an anchor device disposed therein and engaged with the tube to guide the tube to rotate relative to the housing. The tube includes a plurality teeth provided thereon, the anchor device includes a plurality teeth provided thereon, and engageable with the teeth of the tube. The tube includes a plate provided thereon and having the teeth provided on the plate.

The housing includes at least one guide rib extended therefrom, the anchor device includes at least one guide groove formed therein to slidably receive the guide rib of the housing, and to guide the anchor device to slide relative to the housing, and to prevent the anchor device from rotating relative to the housing.

A biasing device may further be provided to bias the anchor device toward and to engage with the tube. A moving device may further be provided to move the ink reservoir relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
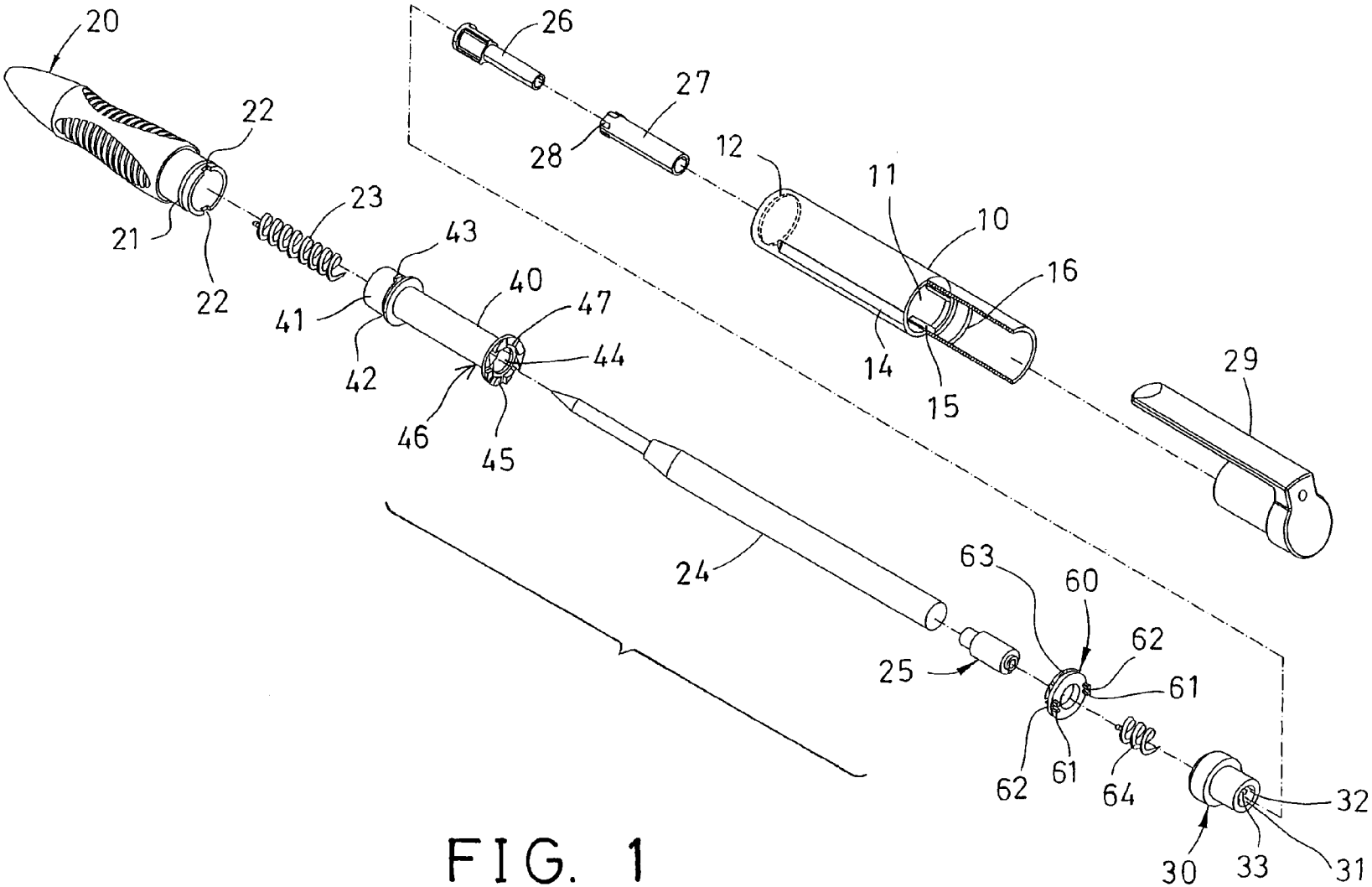
FIG. 1 is an exploded view of a pen in accordance with the present invention.
Figure 2:
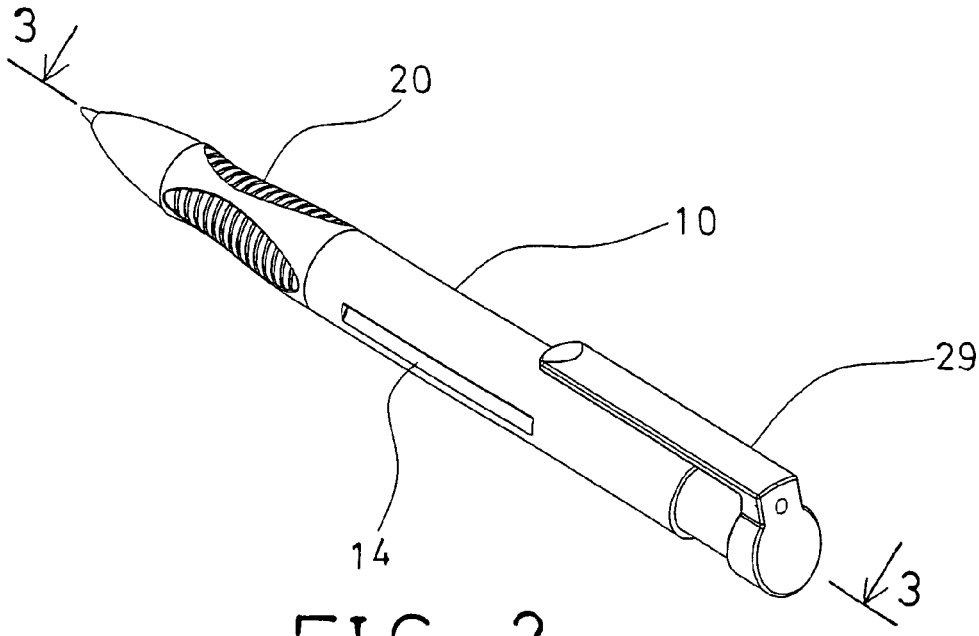
FIG. 2 is a perspective view of the pen.
Figure 3:
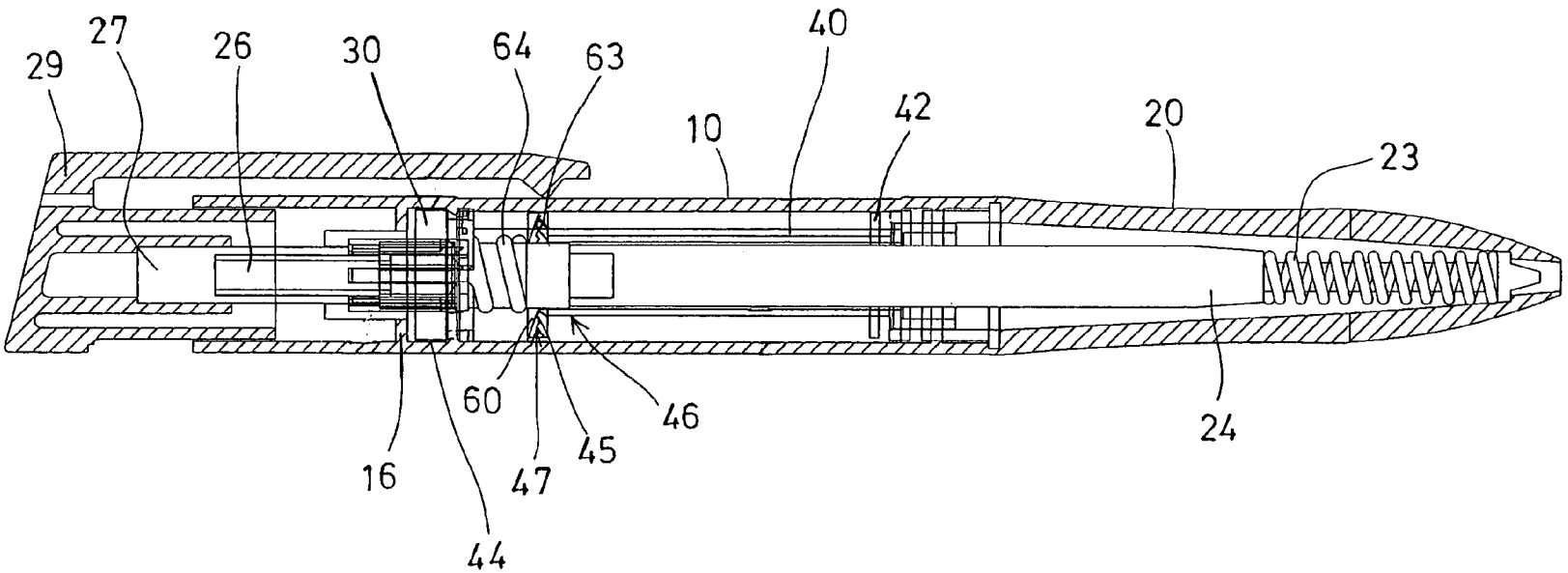
FIG. 3 is a cross sectional view of the pen, taken along lines 3—3 of FIG. 2.

Referring to the drawings, and initially to FIGS. 1–3, a pen in accordance with the present invention comprises a housing 10 including a chamber 11 formed therein, and including a peripheral recess or swelling 12 formed or extended into the chamber 11 thereof, and including a longitudinal slot 14 formed therein and communicating with the chamber 11 thereof. The housing 10 may further include one or more longitudinal guide ribs 15 and one or more peripheral bulges 16 extended into the chamber 11 thereof.

A casing 20 is rotatably attached to the lower end or the front end of the housing 10, and includes a peripheral swelling or recess 21 formed in the outer peripheral portion thereof for slidably or rotatably receiving the corresponding peripheral swelling 12 of the housing 10, and for stably and rotatably attaching the casing 20 to the housing 10, and for preventing the casing 20 from being disengaged from the housing 10. The casing 20 includes one or more notches 22 formed in the upper or rear end thereof.

A spring member 23 is received in the casing 20, and an ink reservoir 24 has a front portion engaged into the casing 20 and engaged with the spring member 23 which may bias the ink reservoir 24 into the casing 20. The ink reservoir 24 may be partially forced or moved out of the casing 20 when the ink reservoir 24 is moved or forced against the spring member 23.

Figure 4:
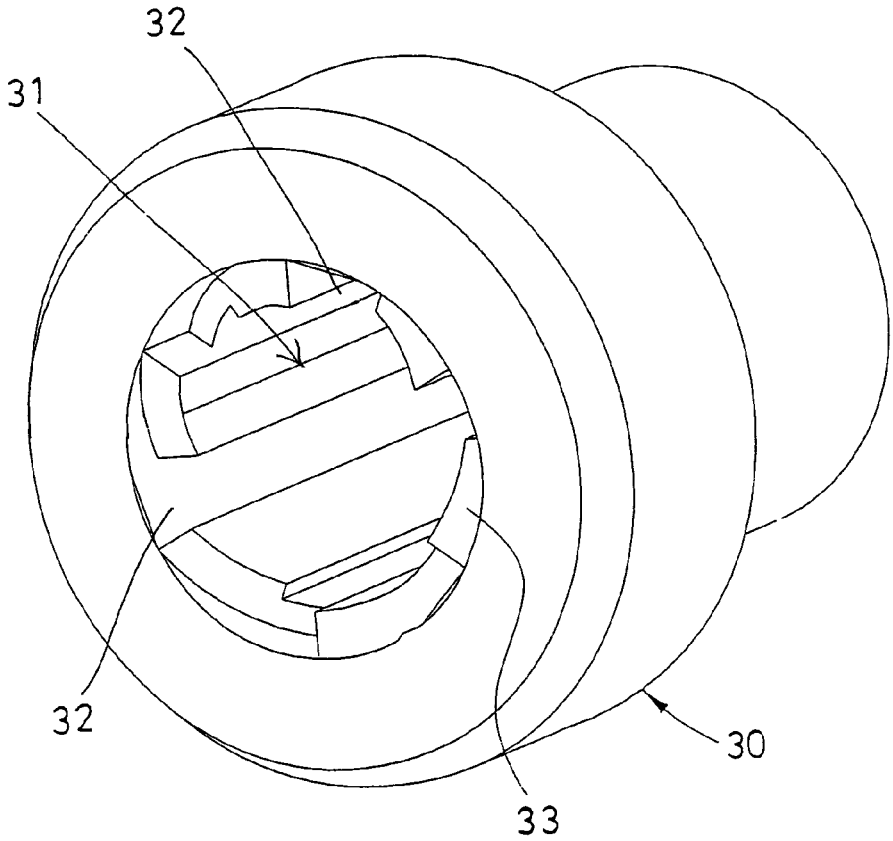
FIG. 4 is an enlarged perspective view showing a control member for controlling the rotating of the pen.

A control member 30 is secured in the housing 10 with such as a force-fitted engagement, and/or anchored to the housing 10 with such as the peripheral bulges 16 of the housing 10. As shown in FIG. 4, the control member 30 includes a tubular structure having a bore 31 formed therein, and one or more guide channels 32 formed therein and communicating with the bore 31 thereof, and defined between guide rails 33.

A lid 25 may further be provided and attached to the upper or rear end of the ink reservoir 24. A follower 26 is engaged onto the upper or rear end of the ink reservoir 24 or the lid 25. A post 27 is slidably attached onto the follower 26 and slidably extended out through the bore 31 of the control member 30, and includes one or more projections 28 extended therefrom for engaging with the guide channels 32 and the guide rails 33 of the control member 30, to control or to retain the ink reservoir 24 in either an outwardly extending or working position or an inwardly receiving or storing position relative to the casing 20.

For example, a cap 29 may be slidably attached onto the housing 10 and engaged with the post 27, to force or move the ink reservoir 24 against the spring member 23. The projections 28 of the post 27 may be selectively engaged with the guide channels 32 and the guide rails 33 of the control member 30, to retain the ink reservoir 24 in either the outwardly extending or working position relative to the casing 20, or the inwardly receiving or storing position relative to the casing 20. The actuation of the ink reservoir 24 relative to the casing 20 is conventional and has been disclosed in U.S. Pat. No. 5,570,967 to Chen which may be taken as a reference for the present invention.

The pen in accordance with the present invention further comprises a tube 40 rotatably received in the housing 10 and having one end 41 engageable into the casing 20, and having a peripheral rib 42 extended radially from the one end 41 thereof and engageable with the casing 20, to anchor the tube 40 to the casing 20. The tube 40 further includes one or more juts 43 extended therefrom for engaging into the notches 22 of the casing 20 (FIG. 5), to further anchor the tube 40 to the casing 20, and to allow the tube 40 to be rotated by the casing 20.

Figure 11:
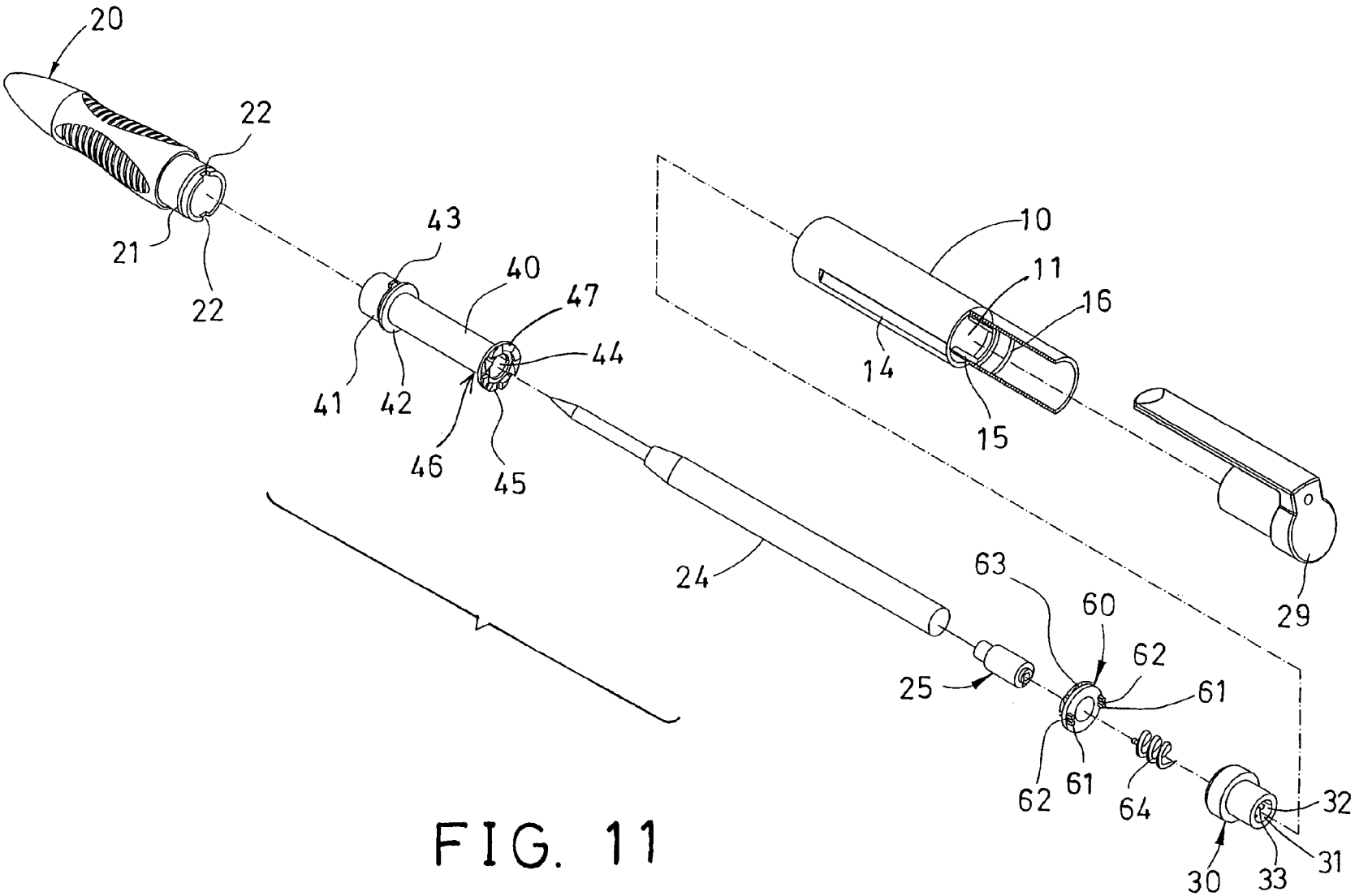
FIG. 11 is an exploded view similar to FIG. 1, illustrating the other arrangement of the pen.

The tube 40 includes a bore 44 formed therein for rotatably and/or slidably receiving the ink reservoir 24, and for allowing the tube 40 to be rotated relative to the housing 10 and the ink reservoir 24, and for preventing the tube 40 from interfering the operation of the ink reservoir 24. The tube 40 further includes a plate 45 formed or provided on the other end 46 thereof and having a number of teeth 47, such as ratchet teeth 47 formed or provided thereon (FIGS. 1, 3, 11).

Figure 5:
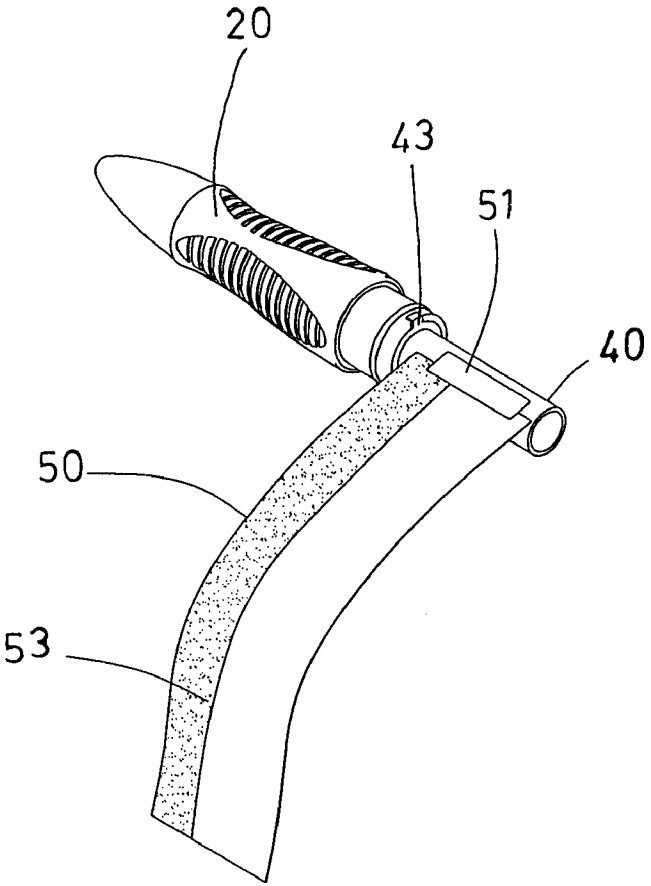
FIG. 5 is a partial perspective view of the pen.

As shown in FIG. 5, a sheet material 50, such as a note paper sheet material 50 may include one end secured onto the tube 40 with an adhesive member 51, and may be wound around the tube 40 and may thus be received in the housing 10 (FIG. 10), and may include an adhesive layer 53 applied thereon for allowing the note paper sheet material 50 to be easily attached onto various objects.

Figure 10:
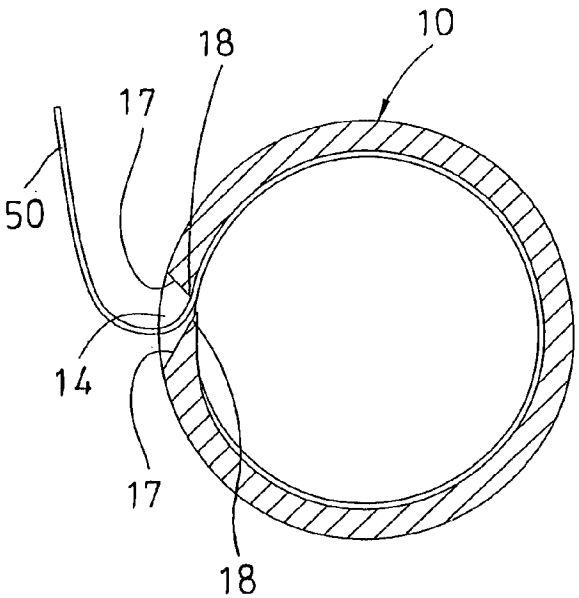
FIG. 10 is a cross sectional view taken along lines 10—10 of FIG. 9.

As best shown in FIG. 10, it is preferable that the housing 10 includes one or more inclined or tapered surfaces 17 formed within or beside the longitudinal slot 14 thereof, to form or define one or more cutting edges 18, and for allowing the note paper sheet material 50 to be easily cut or torn down with the cutting edges 18 (FIGS. 6–9).

Referring again to FIGS. 1, 3, and 11, an anchor device 60 may further be provided and slidably received in the housing 10 and having one or more, such as two guide members 61 extended or provided thereon. Each of the guide members 61 includes a guide groove 62 formed therein to slidably receive the longitudinal guide ribs 15 of the housing 10, and thus to guide the anchor device 60 to slide relative to the housing 10 only, and to prevent the anchor device 60 from being rotated relative to the housing 10.

The anchor device 60 includes a number of teeth 63, such as ratchet teeth 63 formed or provided thereon, to engage with the teeth 47 of the tube 40, and thus to limit the rotational direction of the tube 40 relative to the housing 10 with the anchor device 60. A spring member 64 may be engaged onto the anchor device 60, to bias or force the anchor device 60 toward or onto the plate 45 of the tube 40, and thus to bias the teeth 47, 63 of the tube 40 and the anchor device 60 to be engaged with each other.

Figure 6:
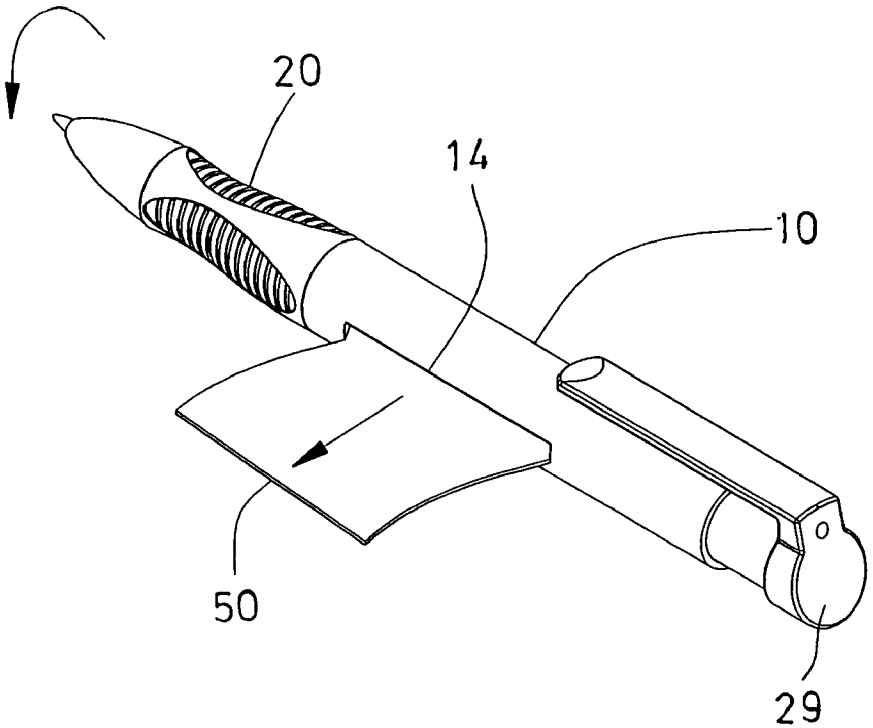
FIGS. 6, 7, 8 are perspective views illustrating the operation of the pen.
Figure 7:
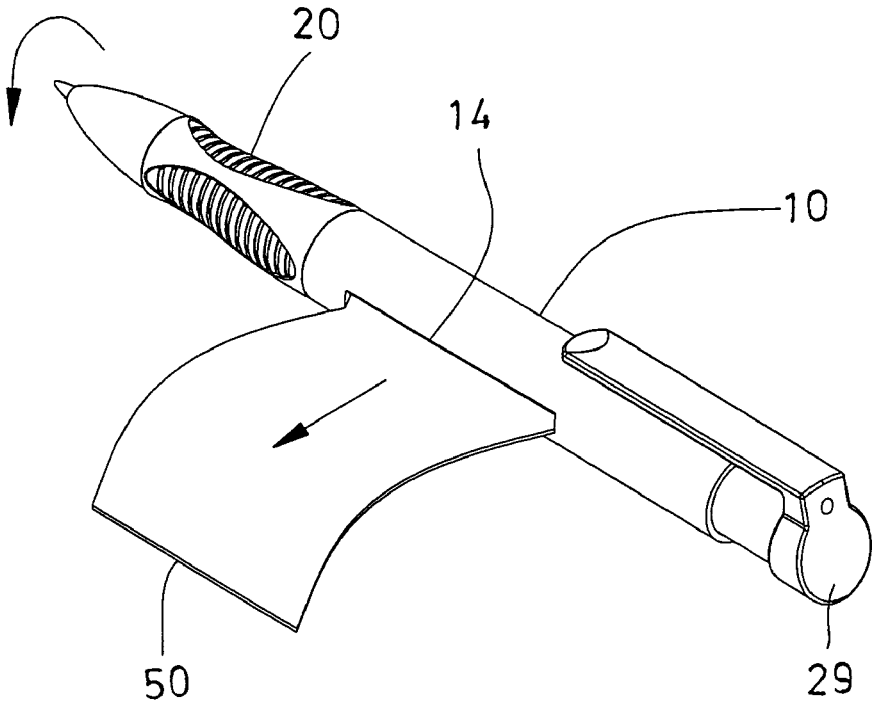
Figure 8:
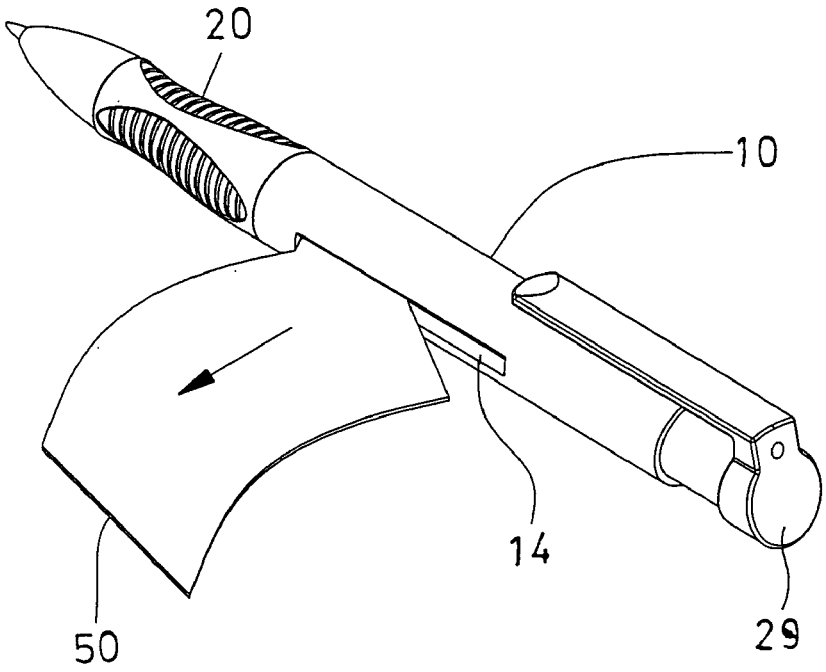
Figure 9:
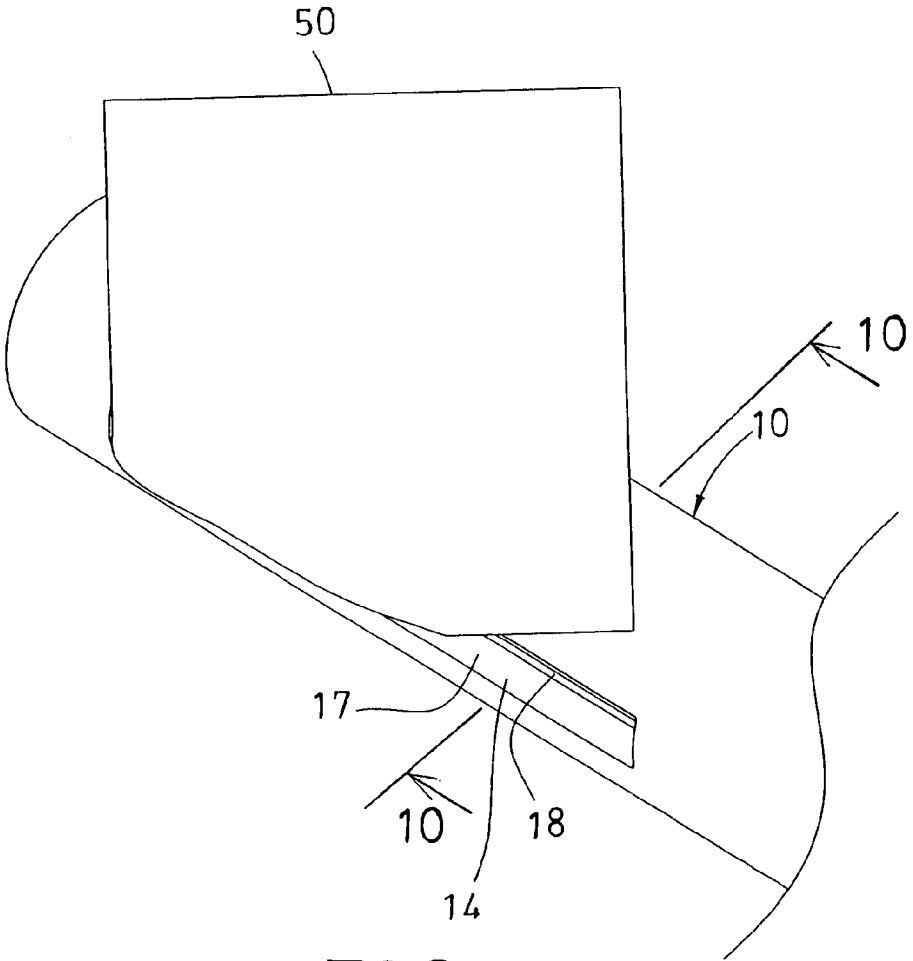
FIG. 9 is an enlarged partial perspective view of the pen.

In operation, the tube 40 may be rotated relative to the housing 10 with the casing 20, and by rotating the casing 20 relative to the housing 10, to move the note paper sheet material 50 out of the housing 10 (FIGS. 6, 7). After the note paper sheet material 50 has been rotated or extended out of the housing 10, the note paper sheet material 50 may further be moved out of the housing 10 by rotating the casing 20, or may be directly pulled out by the users. The note paper sheet material 50 may be cut to the required length with the cutting edges 18 of the housing 10 (FIGS. 8, 9).

It is to be noted that the tube 40 may also be rotated in a reverse direction to move the note paper sheet material 50 into the housing 10 by force; i.e., the anchor device 60 may be forced against the spring member 64 when the tube 40 is forcedly rotated in the reverse direction relative to the housing 10 by users.

Alternatively, as shown in FIG. 11, without the spring member 23 and the follower 26 and the post 27, the ink reservoir 24 may also be solidly retained within the housing 10 and the casing 20, but the nib of the ink reservoir 24 may not be moved in and out of the casing 20.

Accordingly, the pen in accordance with the present invention includes a note paper sheet engaged therein and unwindable by users for easily note taking purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing including a chamber formed therein, a periphery recess extended into the chamber, and a longitudinal slot communicating with the chamber; the housing including least one longitudinal guide rib and at least one peripheral bulge extended into the chamber;

a casing rotatably attached to a lower end or a front end of the housing, and including a peripheral swelling or recess formed in the outer peripheral portion thereof for slidably or rotatably receiving the corresponding peripheral swelling of the housing, and for stably and rotatably attaching the casing to the housing for preventing the casing from being disengaged from the housing; the casing including at least one notch formed in an upper or a rear end thereof;

a spring member received in the casing, and an ink reservoir having a front portion engaged into the casing and engaged with the spring member which biases the ink reservoir into the casing; the ink reservoir moved out of the casing when the ink reservoir is moved or forced against the spring member;

a control member secured in the housing with a force-fitted therein, and anchored to the housing with the peripheral bulges of the housing; the control member including a tubular structure having a bore; and at least one guide channel communicated with the bore; and defined between guide rails;

a lid attached to an upper or a rear end of the ink reservoir, a follower being engaged onto the upper or rear end of the ink reservoir or the lid; a post slidably attached onto the follower and slidably extended out through the bore of the control member; and including at least one projection extended therefrom for engaging with the guide channel and the guide rails of the control member to retain the ink reservoir relative to the casing;

a cap slidably attached onto the housing and engaged with the post to move the ink reservoir against the spring member; the projection of the post being selectively engaged with the guide channels and the guide rails of the control member to retain the ink reservoir relative to the casing;

a tube rotatably received in the housing and having one end engageable into the casing; and having a peripheral rib extended radially from one end thereof and engageable with the casing, to anchor the tube to the casing; the tube further including at least one jut extended therefrom for engaging into the notch of the casing to further anchor the tube to the casing, and to allow the tube to be rotated by the casing; the tube including a bore formed therein; and the tube further including a plate formed on another end thereof; and having a plurality of teeth;

a sheet material having one end secured onto the tube with an adhesive member; and be wound around the tube and thus received in the housing; adhesive layer applied thereon for allowing the sheet material to be easily attached onto various objects; the housing including at least one inclined or tapered surface formed within or beside the longitudinal slot, to form or defined at lease one cutting edge; and for allowing the sheet material to be easily torn down with the cutting edge; and an anchor device slidably received in the housing and having at least one guide member extended thereon; each of the guide members including a guide groove formed therein; the anchor device including a number of teeth to engage with the teeth of the tube, a spring member being engaged onto the anchor device, to bias the anchor device toward the plate of the tube, and thus to bias the teeth of the tube and the anchor device to be engaged to each other.

* * * * *